US005967912A

United States Patent [19]

Hexemer et al.

[11] Patent Number: 5,967,912

[45] Date of Patent: Oct. 19, 1999

[54] LACELOCK FOR A LACROSSE STICK HEAD

[75] Inventors: Matthew Gerald Hexemer, Toronto; Steven Copeland, Barrie; Roger MacLaren Ball, Toronto, all of Canada; Kelly Amonte, Hingham; William H. Brine, III, Hopkinton, both of Mass.; William Brine, Jr., Hanover, N.H.

[73] Assignee: Sports Licensing, Inc., Milford, Mass.

[21] Appl. No.: 09/032,076

[22] Filed: Feb. 27, 1998

[51] Int. Cl.[6] ..... A63B 59/02

[52] U.S. Cl. ..... 473/513

[58] Field of Search ..... 473/513

[56] References Cited

U.S. PATENT DOCUMENTS

| | | | |
|---|---|---|---|
| 4,034,984 | 7/1977 | Crawford et al. | 473/513 |
| 4,861,042 | 8/1989 | Trettin | 473/513 |

*Primary Examiner*—William H. Grieb
*Attorney, Agent, or Firm*—Brian M. Dingman

[57] ABSTRACT

A lacelock for a lacrosse stick head generally comprising a mechanical device affixed to a lacrosse head frame which interacts with one or more of the thongs and/or netting materials of the lacrosse head to securely hold the thongs or netting materials at a desired tension and to enable a person to readily release and adjust the tension of the thongs and/or netting materials as desired and relock into place.

12 Claims, 8 Drawing Sheets

LACELOCK FOR A LACROSSE STICK HEAD

FIELD OF THE INVENTION

This invention relates to lacrosse sticks and more specifically to a lacelock for locking the thongs and/or netting materials of a lacrosse stick head wherein the lacelock can be quickly and easily released to adjust the tension of the thongs and/or netting materials and relocked.

BACKGROUND OF THE INVENTION

Lacrosse sticks having netting holes in the lacrosse head frame configured to accept the thongs, shooting strings and netting strings of a lacrosse stick head therethrough are well known in the art. After the thongs, shooting strings or netting strings are threaded through the netting holes, each is individually knotted to retain the thong or string in a fixed position relative to its respective netting hole. Any adjustment of a thong or string requires the user to undue the knot holding the thong or netting string in place, adjust the length or tension of the thong or string, and reknot each thong or netting string. Adjusting one or more thongs or netting strings is tedious and time consuming. The exterior knots also frequently loosen during play, however, any adjustment on the playing field is virtually impossible. Moreover, these knots do not enable the user to adjust the tension of the thongs or netting threads with sufficient accuracy and often require the user to repeatedly knot and reknot each thong or netting string to achieve the desired tension or length.

SUMMARY OF THE INVENTION

It is therefore a primary object of this invention to provide a lacrosse stick head with an improved means for fixing the thongs, netting strings or shooting strings in place relative to the lacrosse head frame.

It is a further object of this invention to provide a lacrosse stick head with a lacelock for fixing the thongs, netting strings or shooting strings at a desired tension.

It is a further object of this invention to provide a lacrosse stick head with a means for adjusting the length and tension of the thongs, netting strings or shooting strings quickly and easily.

It is a further object of this invention to provide a lacrosse stick head with a means for adjusting the length and tension of the thongs, netting strings or shooting strings with improved accuracy.

A preferred embodiment of the lacelock of this invention for a lacrosse stick head comprises a frame and one or more of a plurality of thongs, a plurality of netting strings and a plurality of shooting strings, strung through bores and/or channels provided through the perimeter of the frame, each having a desired length or tension, comprising, a means for releasable locking one or more of the thongs, the netting strings and/or the shooting strings at their respective desired lengths or tensions, wherein the means for releasably locking is affixed to the frame. The means for releasably locking forcibly counteracts or inhibits backward movement of one or more of the thongs, netting strings and/or shooting strings through their respective bores and/or channels provided in the frame using compression and/or a positive locking means.

A preferred embodiment of the means for releasably locking comprises one or more set screws which releasably lock one or more of the thongs, the netting strings or the shooting strings at their respective desired lengths or tensions between the set screws and the frame, wherein one or more of the set screws are removably affixed to the frame through one or more bores provided in the frame. The set screws may be positioned so that the set screws are capable of being inserted into one or more bores provided in one or more of the thongs.

The preferred embodiment of the means for releasably locking may also comprise one or more wedges or cams which compress and frictionally hold one or more of the thongs, the netting strings or the shooting strings at a desired tension between one or more of the wedges or cams and the frame, wherein the wedge or cam may be removably affixed to the frame. The cam or wedge preferably compresses the thongs or strings into a depression provided in the surface of the frame. One or more catches or tabs may also be provided on the lacelock for further fixing the cam or wedge in a locked position. The cam may further comprise one or more positive locking means comprising one or more dowels protruding from the cam which are capable of engaging one or more bores provided in one or more of the thongs.

The means for releasably locking may also comprise one or more clamps which hold one or more of the thongs, the netting strings or the shooting strings at a desired tension between one or more of the clamps and the frame, wherein the clamp is removably affixed to the frame, wherein one or more of the clamps has two opposing inner surfaces, and wherein one or more of the clamps, when tightened, traps one or more of the thongs, netting strings and/or shooting strings between the two opposing surfaces. The clamp may further comprise one or more positive locking means comprising one or more protruding dowels capable of engaging one or more bores provided in one or more of the thongs.

Another preferred embodiment of the lacelock of this invention for a lacrosse stick head comprising a frame and one or more of a plurality of thongs, a plurality of netting strings and a plurality of shooting strings, strung through bores and/or channels provided through said frame, wherein each thong or string has a desired length or tension, comprises, a means for releasably locking one or more of the thongs, the netting strings and the shooting strings at their respective desired lengths or tensions, wherein at least a portion of the means for releasably locking is integral with the frame. This embodiment may include one or more of the features described above with respect to the previously described embodiments.

This invention is the result of efforts to design a lacelock for a lacrosse stick head which can be easily and quickly locked, unlocked and relocked, thereby facilitating adjustment of the laces of the lacrosse stick head without undue time and effort. The invention may be adapted to all types of lacrosse stick heads and other game playing devices having strings or netting materials incorporated therein.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE PREFERRED EMBODIMENT

Figure 1A:
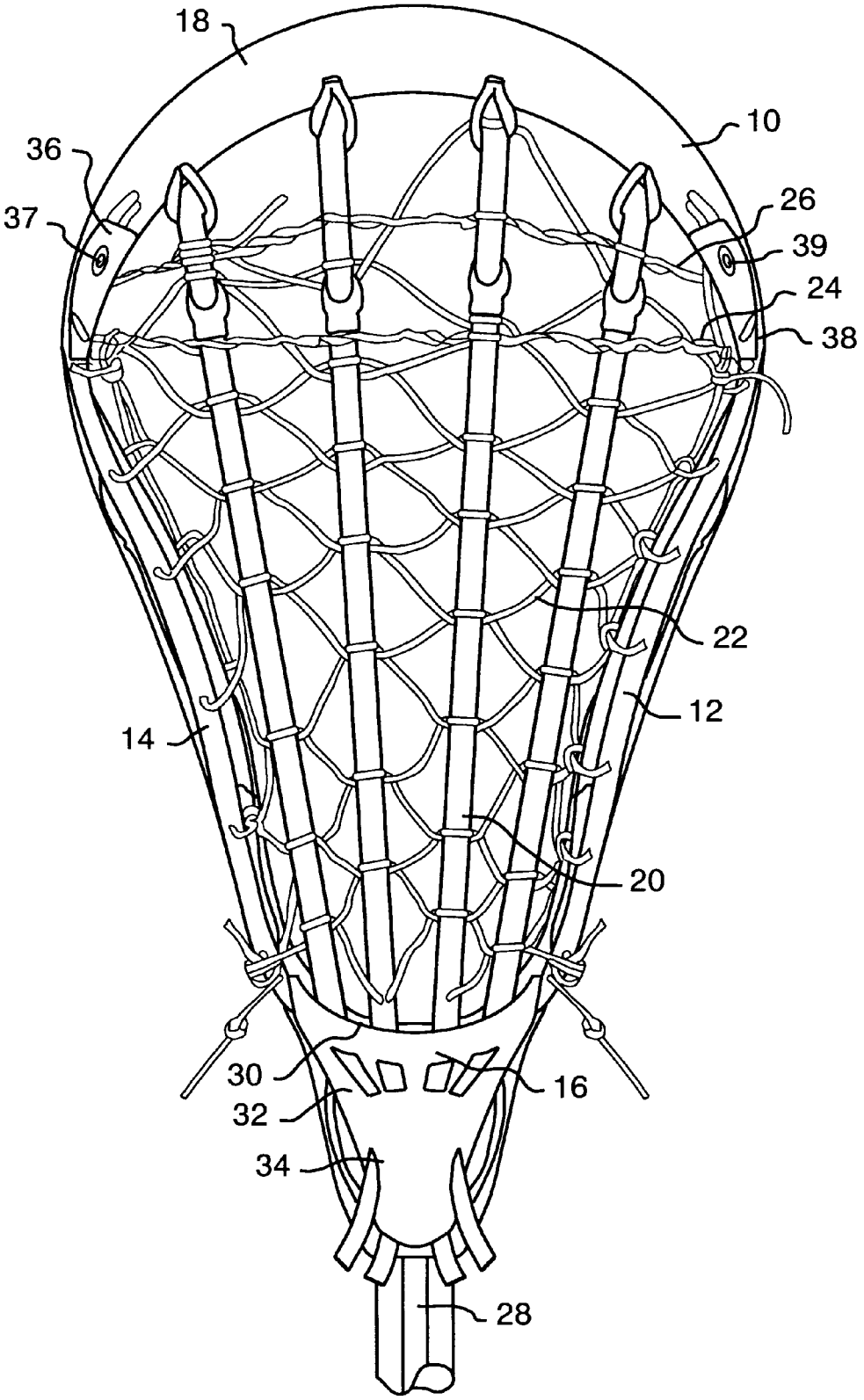
FIG. 1A is a view of the underside of a preferred embodiment of the invention.

This invention generally comprises a mechanism for locking the lacing materials of a lacrosse head into place after the lacing materials have been strung and stretched to their respective desired tensions within the frame of the lacrosse head. This mechanism comprises a base portion which is fixed to or integral with the lacrosse head and a locking portion, such as one or more set screws or pivotal cams, which frictionally holds the lacing materials at their desired tension, thus inhibiting unwanted loosening of the lacing materials during play.

FIG. 1 illustrates two preferred embodiments of the lacelock of this invention affixed to a lacrosse stick head generally referred to as lacrosse head 10. The frame of lacrosse head 10 is made up of a throat portion 16, sidewalls 12 and 14 which diverge from throat portion 16, and lip portion 18 which joins sidewalls 12 and 14 opposite from throat portion 16. Ball stop 30 is shown adhesively fixed to throat portion 16, and stick 28 is shown inserted into a hollow cylindrical-like cavity, (not shown), provided in the lower portion of lacrosse head 10. Stick 28 is removably held in position by threaded screw 35 shown in FIG. 1C.

Four vertical, preferably leather, thongs are strung from lip portion 18 to throat portion 16, e.g. thong 20. Netting strings 22 are strung transversely between sidewalls 12 and 14 and from lip portion 18 to throat portion 16. Shooting strings 24 and 26 are strung transversely between the upper portions of sidewall 12 and sidewall 14. Lacelock 32 is affixed to the underside of lacrosse head 10 at throat portion 16. Cam 34 of lacelock 32 is pivotally affixed to lacelock 32 by dowel 33 as shown in FIGS. 1B and 1C.

Figure 1B:
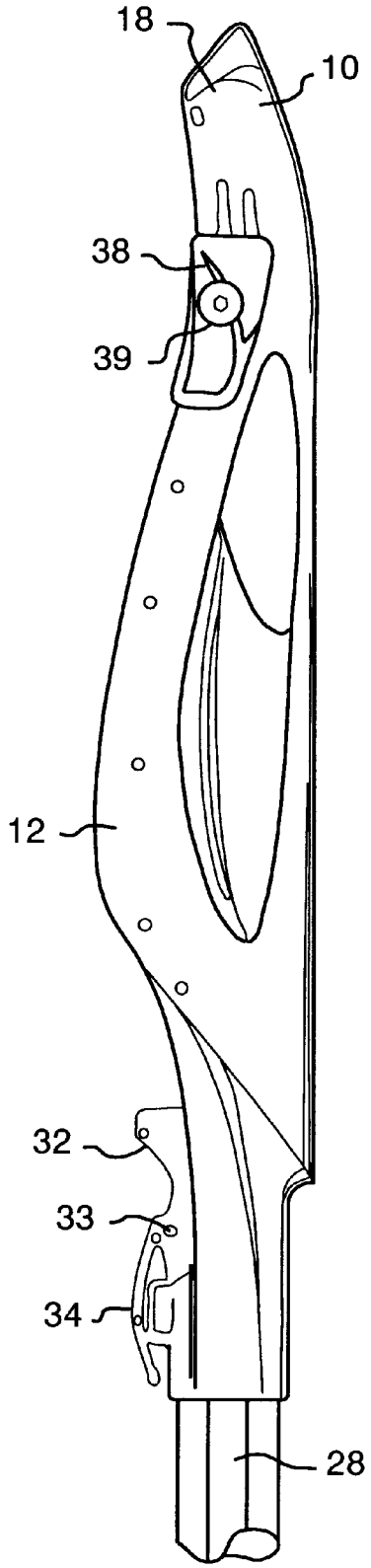
FIG. 1B is a lateral view of the left side of the embodiment shown in FIG. 1A without the lacing materials therein.
Figure 1C:
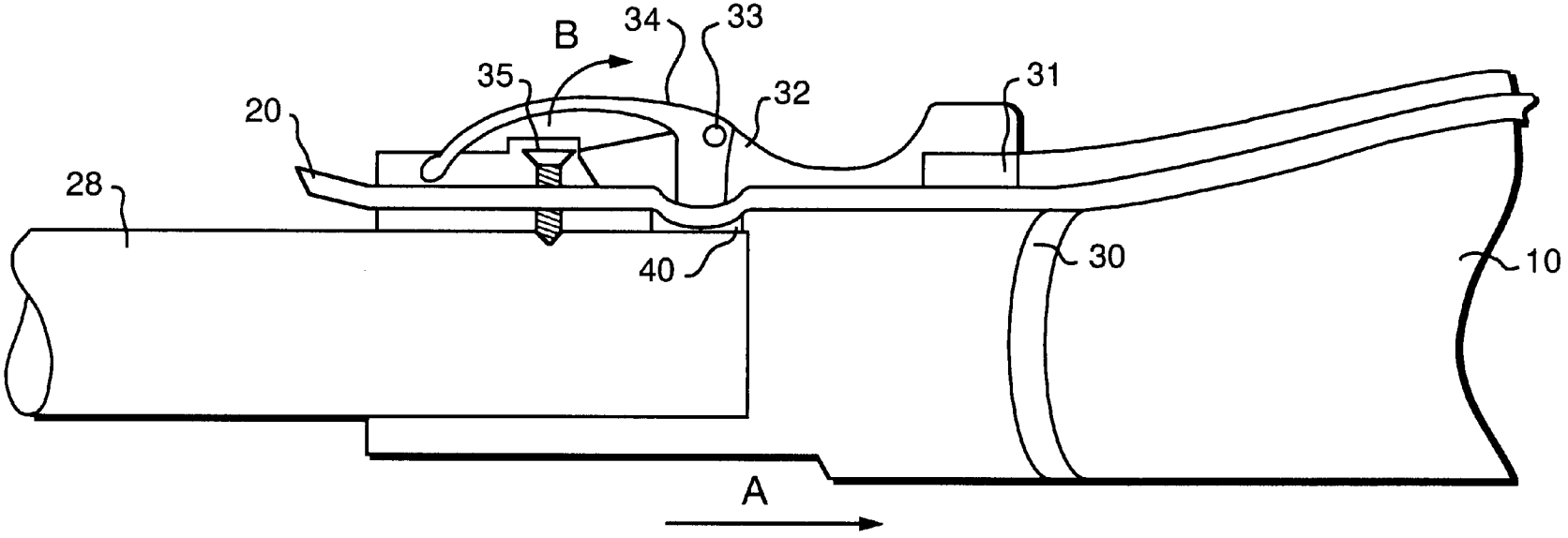
FIG. 1C is a partial cross-sectional view of the left side of the embodiment shown in FIG. 1A.

FIG. 1C is an enlarged cross-sectional view of a portion of lacrosse head 10 showing cam 34 of lacelock 32 fully engaged with thong 20 in the area of depression 40. Cam 34 compresses thong 20 into depression 40 thus inhibiting the backward movement of thong 20 through a channel in the direction of arrow A. To use the lacelock, cam 34 is pivoted in a clockwise direction around dowel 33 as shown by arrow B. Each thong, including thong 20, is then threaded through a channel formed between two channel walls, e.g. channel walls 31 and 44, and under cam 34. After the thongs are stretched to the desired tension, cam 34 is rotated back around dowel 33 and pressed firmly into place against all four thongs. One or more catches or tabs (not shown) may be provided on lacelock 32 to engage cam 34 in a locked position. The catches or tabs may be arranged in a series to enable a user to adjustably compress the cam based on the thickness or resiliency of the thong material. For example, if a thong is thin, then the cam may be fully compressed to engage the catch or tab located closest to the frame surface.

A strip of material having a textured or resilient surface may be adhesively or otherwise fixed to the surface of cam 34, which engages the thong, or depression 40. The surface itself of cam 34 or depression 40 may be textured using any number of suitable topographical features including but not limited to ridges, nubs and/or spikes. Both a textured surface and a resilient surface will increase the area of contact between cam 34 or depression 40 and the thongs, thus enhancing the strength of the lacelock. In addition, sharp topographical features capable of penetrating the surface of the thong will act as a positive lock on the thong.

All or a portion of the base of lacelock 32 may be molded integrally with lacrosse head 10. Lacrosse head 10, cam 34 and dowel 33 are preferably made from a polymeric material but may comprise any material suitable for use.

Figure 1D:
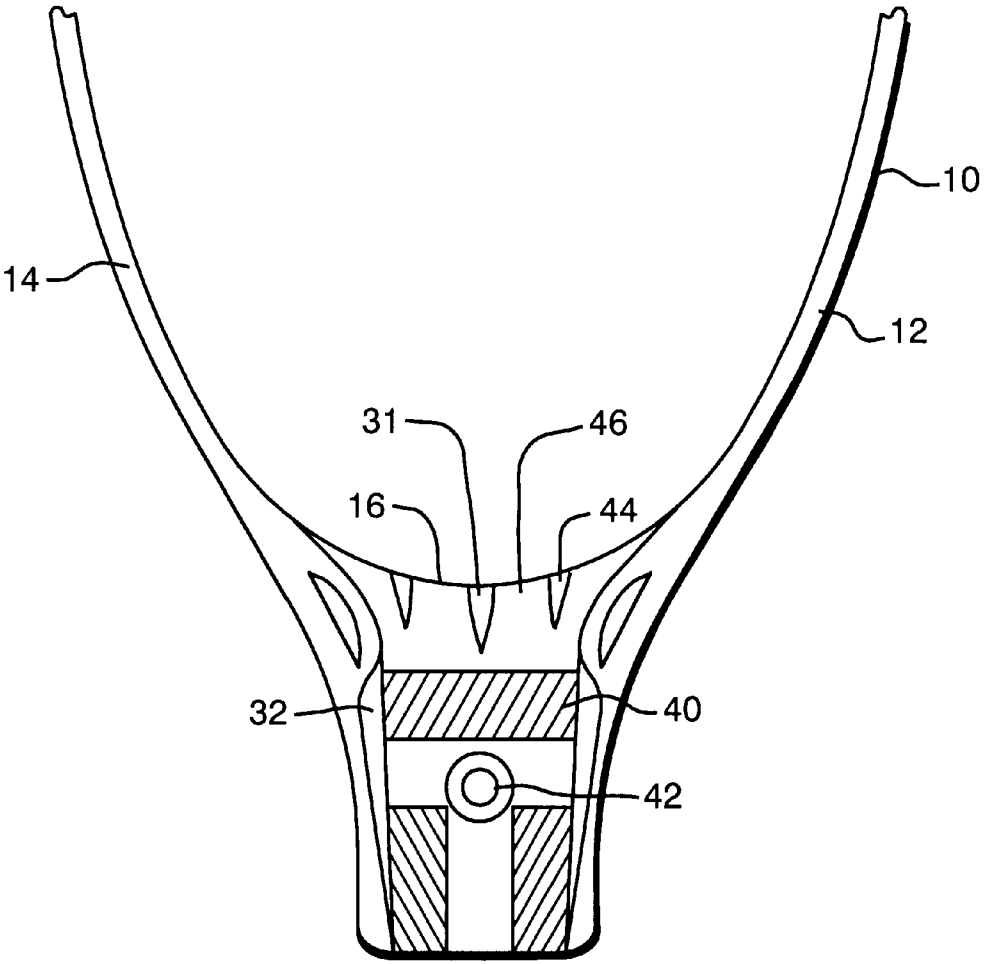
FIG. 1D is a partial view of the underside of the embodiment shown in FIG. 1C without cam 34.

FIG. 1D is a partial underside view of lacrosse head 10 without cam 34 or the thongs or netting strings. Depression 40 is formed in lacrosse head 10, as shown below channel 31 and throat portion 16, having a cavity of sufficient dimensions to engage cam 34. Bore 42 should be large enough to accept threaded screw 35 (not shown). Channel 46 is bounded by channel walls 31 and 44.

Clamps 36 and 38 are also shown in FIGS. 1A and 1B. In FIG. 1A, clamps 36 and 38 are shown engaging shooting strings 24 and 26 at the upper portion of sidewalls 12 and 14 respectively. Clamps 36 and 38 each comprise two opposing inner surfaces and screws 37 and 39 respectively. After shooting strings 24 and 26 are strung transversely between the upper portions of sidewalls 12 and 14 and through netting holes or bores provided through both sidewalls 12 and 14, the shooting strings are threaded between the opposing inner surfaces of clamps 36 and 38. Screws 37 and 39 are then tightened down, trapping both shooting strings within clamps 36 and 38 respectively. The shape, size, position and means for pressing the clamp's inner opposing surfaces together are not limited to those features shown in FIGS. 1A and 1B. These features are limited only in terms of their suitability for use with a lacrosse head. Factors which will affect suitability include size, weight, aerodynamic forces and safety. For example, the clamp may comprise a spring-loaded means for pressing the inner opposing surfaces together. Moreover, the clamp may be located remotely on the lacrosse head from the netting holes through which a given string or thong is drawn. For example, the shooting strings may be threaded through the upper netting holes, run down the sidewalls, and remotely fixed at their desired tensions using anyone of the lacelocks described herein located proximate the throat portion of the lacrosse head. The inner opposing surfaces of the clamp may also have a textured or resilient surface as described above.

Figure 2A:
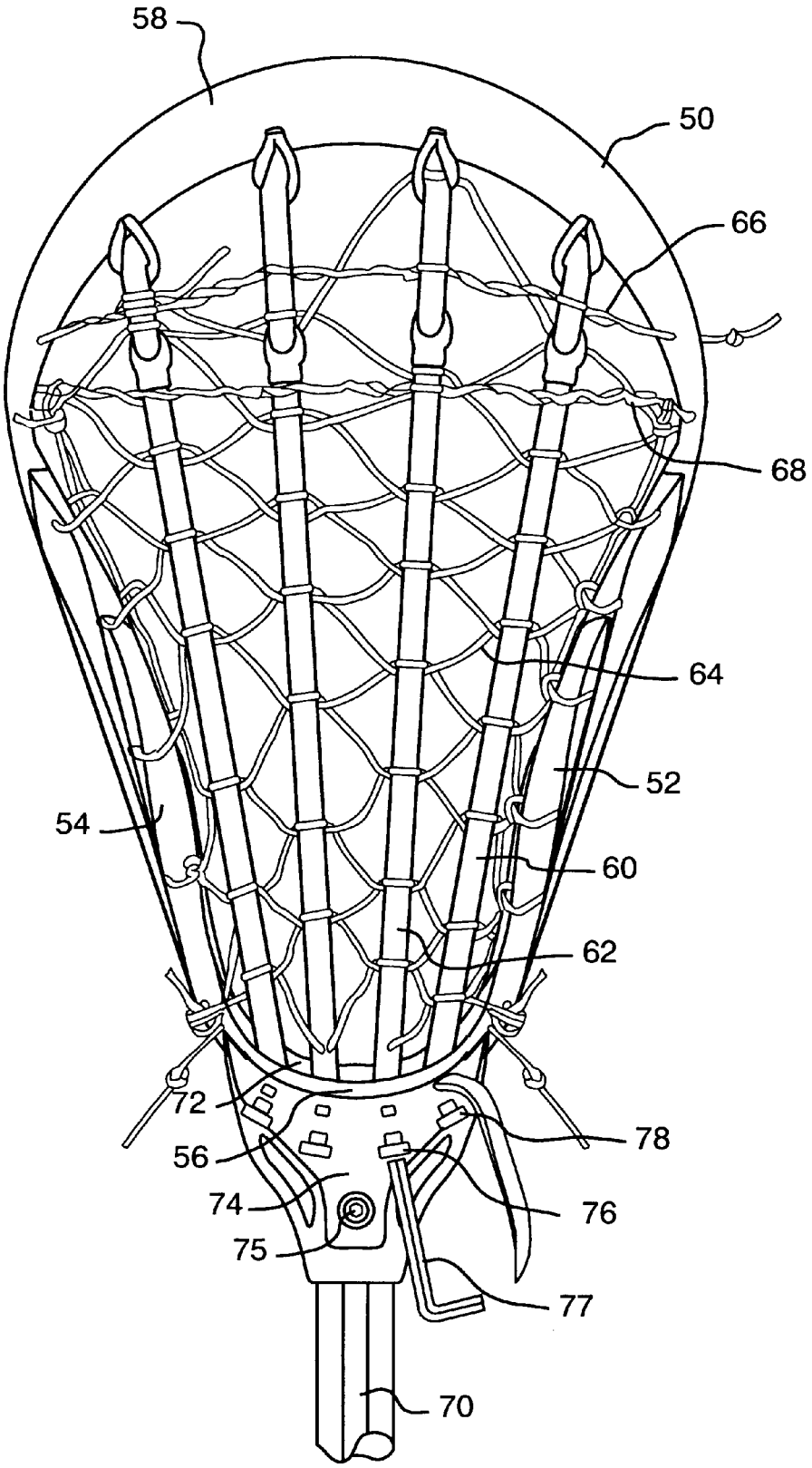
FIG. 2A is a view of the underside of another preferred embodiment of the invention.
Figure 2B:
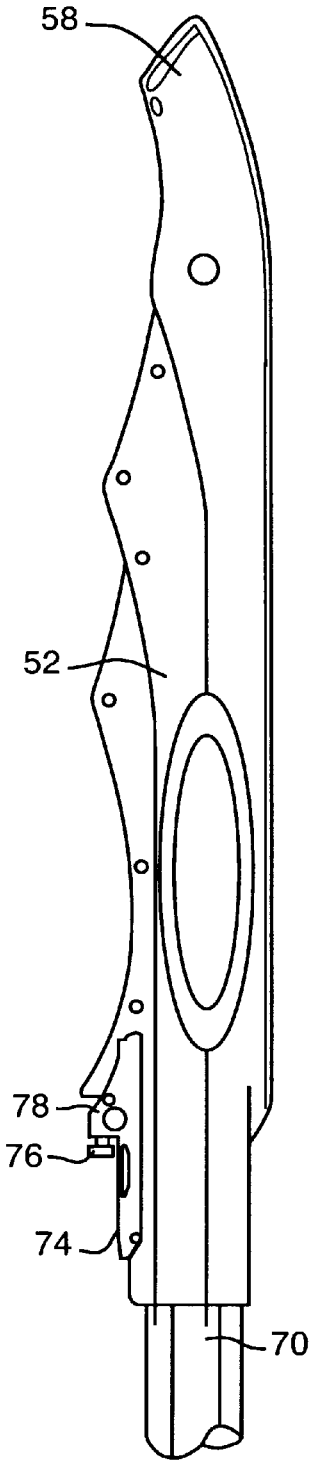
FIG. 2B is a lateral view of the left side of the embodiment shown in FIG. 2A without the lacing materials therein.
Figure 2C:
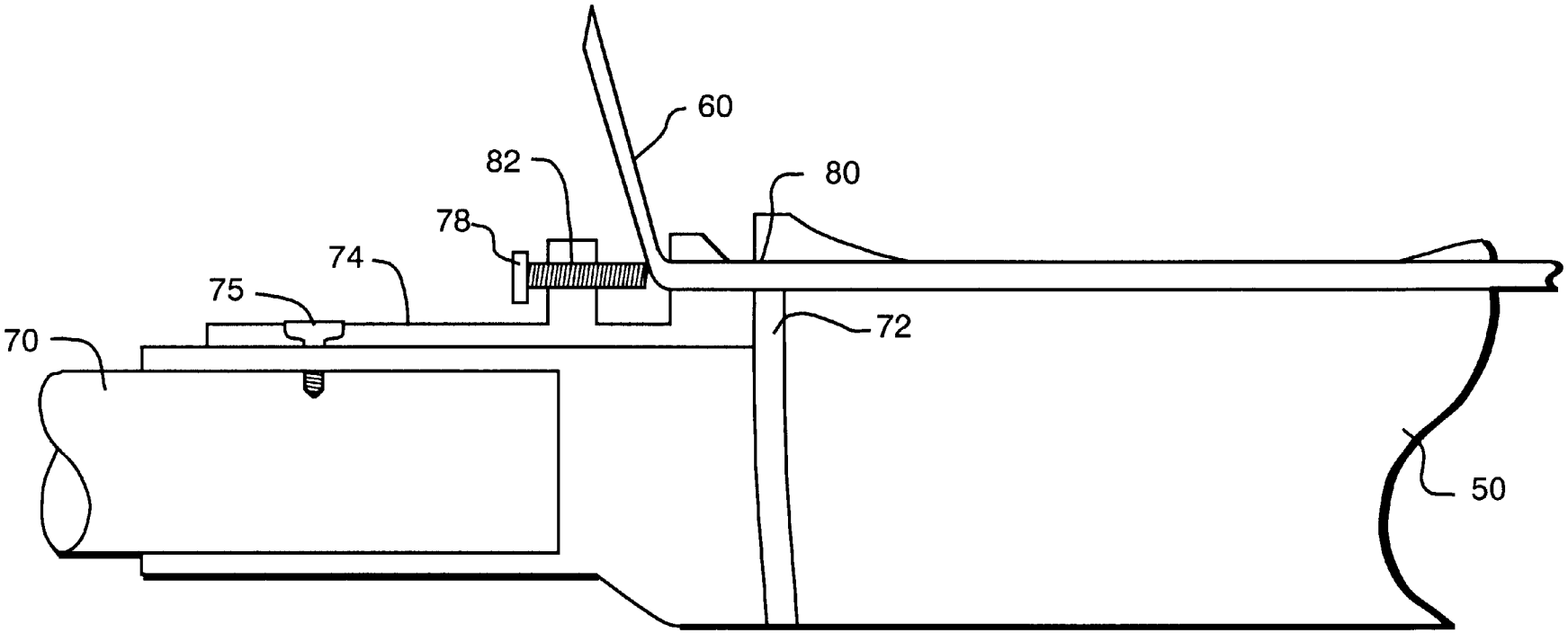
FIG. 2C is a partial cross-sectional view of the left side of the embodiment shown in FIG. 2A.

Another preferred embodiment of the lacelock is shown in FIGS. 2A, 2B and 2C. Lacrosse head 50 is generally similar in structure to lacrosse head 10 described above. The frame of lacrosse head 50 is made up of a throat portion 56, sidewalls 52 and 54 which diverge from throat portion 56, and lip portion 58 which joins sidewalls 52 and 54 opposite from throat portion 56. Ball stop 72 is adhesively fixed to throat portion 56 and stick 70 is shown inserted into a hollow cylindrical-like cavity, (not shown), provided in the lower portion of lacrosse head 50. Stick 70 is removably held in position by threaded screw 75 as shown in FIG. 1C.

Four vertical thongs are strung from lip portion 58 to throat portion 56, e.g. thongs 60 and 62. Each of the four vertical thongs are threaded through a corresponding bore, (not shown), provided in throat portion 56. Netting strings 64 are strung transversely between sidewalls 52 and 54 and from lip portion 58 to throat portion 56. Shooting strings 66 and 68 are strung transversely between the upper portions of sidewall 52 and sidewall 54. Lacelock 74 is affixed to the underside of lacrosse head 50 at throat portion 56. The lacelock is preferably affixed to lacrosse head 50 with the same screw 75 as is used to hold stick 70 within the hollow cavity of lacrosse head 50. Similar to the first embodiment described above, all or a portion of the base of lacelock 74 may be molded integrally with lacrosse head 50. Lacrosse head 50 and lacelock 74 are preferably made from a durable polymeric material but may comprise any material suitable for use. Lacelock 74 is provided with four set screws corresponding to each of the four thongs, e.g. set screws 76 and 78. The set screws are preferably aluminum and should have a polygonal indentation in each head corresponding to key 77 having the same number of polygonal sides for engaging and disengaging the set screws quickly and easily.

FIG. 2C is an enlarged cross-sectional view of a portion of lacrosse head 50 showing set screw 78 of lacelock 74 engaging thong 60. Thong 60 has been threaded through bore 80 provided through throat portion 56 and lacelock 74. Thong 60 is then stretched to its desired tension and once positioned, thong 60 is fixed in place by turning set screw 78 until it firmly engages the surface of thong 60. Each set screw is removably fixed to the base of lacelock 74 by threaded bore, e.g. bore 82.

Figure 3:
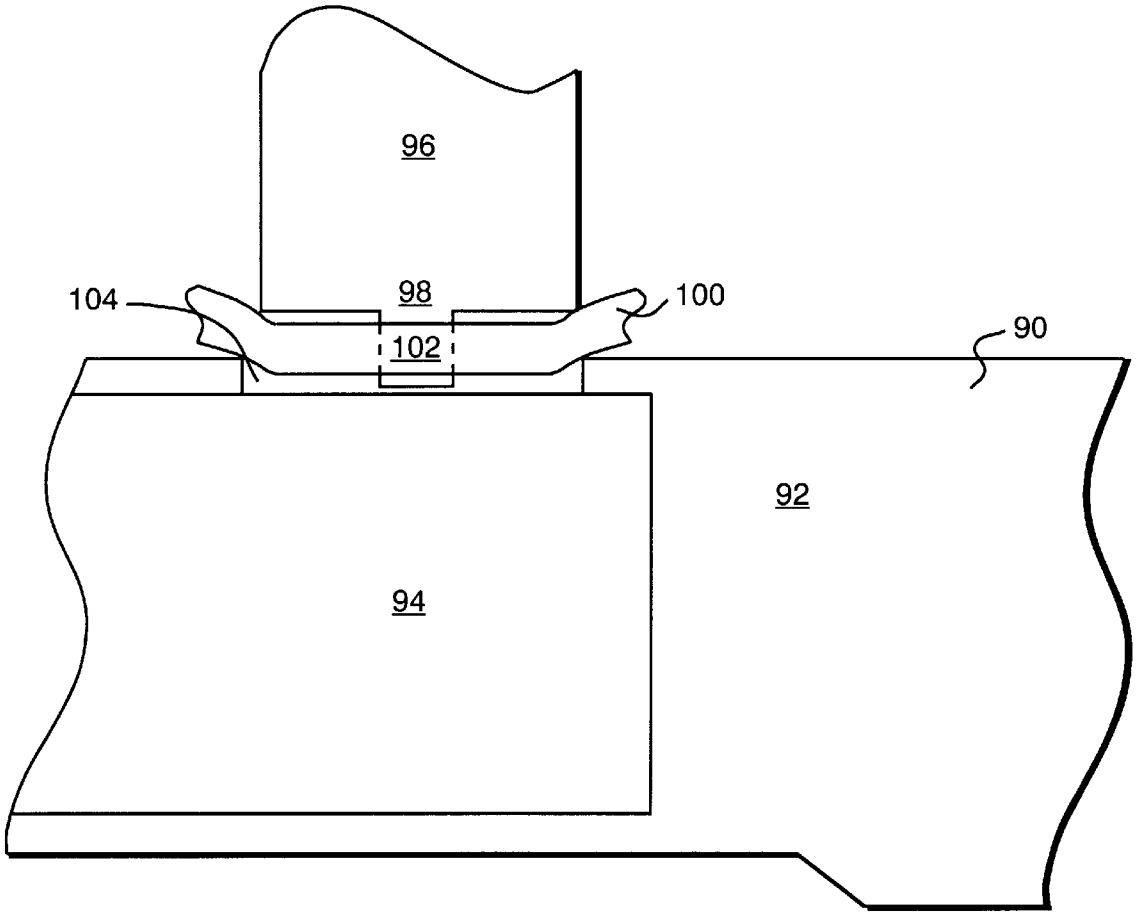
FIG. 3 is a partial cross-sectional view of another preferred embodiment of the invention.

Another preferred embodiment of the invention is shown in FIG. 3. In general this embodiment comprises a cam with one or more dowels integral with the cam which fit into one or more holes cut out of the lacrosse head laces. The thong is drawn through the cam and when the thong is positioned at the desired tension, the dowel is inserted into the hole in the thong closest to the dowel at the desired tension by closing the cam onto the thong, thus trapping the thong in between the cam and the lacrosse head frame. The dowels preferably have a round cross-section but other suitable shapes may be used. The dowels may also have a textured or resilient surface for additional friction or a threaded surface for engaging a bore provided in the lacrosse head. The term dowel for purposes of the invention includes any device capable of being inserted into a hole or opening in the thong such as pins, screws or pegs and may be integral with, affixed to, or removably attached to the cam. Dowels may also be used on or in connection with the clamps described above.

Figure 4:
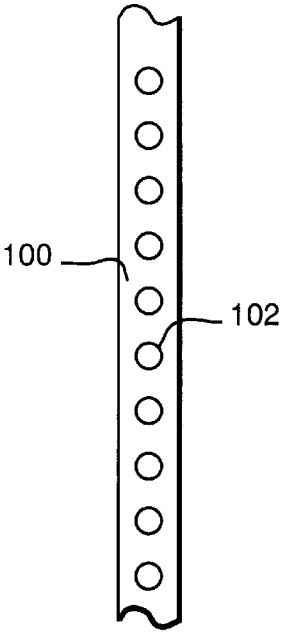
FIG. 4 is a view of the top side of the thong shown in FIG. 3.

Lacrosse head 90 is shown engaging lacrosse handle 94 and provided with depression 104 proximate the upper surface of throat portion 92. A dowel 98 protrudes from cam 96 and is shown engaging bore 102 provided in thong 100. FIG. 4 is a top view of thong 100 in which a plurality of holes are cut or punched out of thong 100 including, for example, bore 102. When inserted into bore 102 of thong 100, dowel 98 locks thong 100 into position. Cam 96 preferably comprises as many dowels as there are thongs. The dimensions of the bores should be sufficient to accept the dowels therethrough without undue slack. The number of bores punched out of the thongs will depend on the accuracy of tensioned desired and the strength of the thong material.

Each of the above embodiments may be adapted to lock one or more thongs, netting strings or shooting strings at a desired tension. Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A lacelock for a lacrosse stick head comprising a frame and one or more laces selected from a group consisting of thongs, netting strings and shooting strings, strung through a plurality of bores or channels provided in said frame, wherein said laces have a desired length and tension, comprising, a lock, removably fixed to said frame, which locks one or more of said laces at said desired length and tension between said frame and said lock, wherein said lock comprises one or more locking devices selected from a group consisting of pivotal cams, set screws and clamps.

2. The lacelock of claim 1, wherein one or more of said locking device comprises one or more set screws.

3. The lacelock of claim 1, wherein one or more of said locking device comprises one or more cams.

4. The lacelock of claim 3, wherein said locking device further comprises a textured surface adapted to frictionally engage one or more of said laces.

5. The lacelock of claim 1, wherein one or more of said locking device comprises one or more clamps.

6. The lacelock of claim 5, wherein one or more of said clamps has two opposing inner surfaces, and wherein one or more of said clamps, when locked, traps one or more of said laces.

7. A lacelock for a lacrosse stick head comprising a frame and one or more laces selected from a group consisting of thongs, netting strings and shooting strings, strung through a plurality of bores or channels provided in said frame, wherein said laces have a desired length and tension, comprising, a base portion fixed to said frame; and a lock, removably fixed to said base portion, which locks one or more of said laces at said desired length and tension between said frame and said lock, wherein said lock comprises one or more locking devices selected from a group consisting of pivotal cams and set screws.

8. The lacelock of claim 7, wherein one or more of said locking device comprises one or more set screws which releasably lock one or more of said laces between said set screws and said base portion.

9. The lacelock of claim 7, wherein one or more of said locking device comprises one or more cams which frictionally lock one or more of said laces between one or more of said cams and said base portion.

10. A lacelock for a lacrosse stick head comprising a frame having a throat portion and one or more thongs strung through a plurality of bores or channels provided in said frame, wherein each of said thongs has a desired length and tension and provided with a plurality of holes therein, comprising, a lock for releasably locking one or more of said thongs at their respective desired lengths and tensions, comprising, one or more pivotal cams fixed to said throat portion;

one or more dowels, fixed to an underside of one or more of said pivotal cams and capable of being inserted into one or more of said holes provided in one or more of said thongs.

11. A lacelock for a lacrosse stick head comprising a frame having opposing sidewalls and one or more shooting strings strung between said opposing sidewalls through a plurality of bores or channels provided in said sidewalls, wherein each of said shooting strings has a desired length and tension, comprising, a lock for releasably locking one or more of said shooting strings at their respective desired lengths and tensions, comprising, one or more clamps fixed to at least one of said sidewalls.

12. The lacelock of claim 11, wherein said clamp further comprises two opposing inner surfaces, wherein one or more of said shooting strings is locked between at least said two opposing inner surfaces of said clamp.

* * * * *